US005645234A

United States Patent [19]

Del Zotto

[11] Patent Number: 5,645,234

[45] Date of Patent: Jul. 8, 1997

[54] COMPACT REDUCTION GRINDER

[76] Inventor: William M. Del Zotto, 2300 Commonwealth Ave., Duluth, Minn. 55805-1699

[21] Appl. No.: 665,489

[22] Filed: Jun. 18, 1996

[51] Int. Cl.[6] ..... B02C 21/02

[52] U.S. Cl. ..... 241/101.76; 241/186.35; 241/224; 241/239; 241/282

[58] Field of Search ..... 241/101.76, 186.35, 241/222, 224, 239, 259.2, 282, 37

[56] References Cited

U.S. PATENT DOCUMENTS

| | | | |
|---|---|---|---|
| 3,559,898 | 2/1971 | Rinke | 241/101.76 |
| 5,197,682 | 3/1993 | Del Zotto | 241/239 X |
| 5,417,375 | 5/1995 | Peterson et al. | 241/35 |
| 5,509,613 | 4/1996 | Page | 241/282 |

*Primary Examiner*—John M. Husar
*Attorney, Agent, or Firm*—D. L. Tschida

[57] ABSTRACT

A trailered, short stroke reduction grinder including a telescoping, multi-stage push ram and hydraulic grinding head which are operable from seat mounted joy sticks in an enclosed operator cabin. Collected reduction materials are pushed to a grinding channel defined between multiple arcuate, sizing screens and the rotating grinding head. A hydraulic shear bar controls the entry of the material to the grinding channel. The grates of the sizing screen are arranged to provide a plurality of reduction apertures of progressively increasing size and differing geometric shape. A single hydraulic motor and belt drive linkage control the grinding head and permit forward and reverse operation. High density plastic slide bearings at cross supports of a discharge conveyor support a ribbed belt.

13 Claims, 9 Drawing Sheets

COMPACT REDUCTION GRINDER

BACKGROUND OF THE INVENTION

The present invention relates to reduction grinders and, in particular, to a grinder for reducing landfill debris, road surface materials, rock, and logs, among a variety of materials to a ground particulate.

Reduction grinders have been designed to abrade, shred and grind to size a variety of work materials from grains to rock to road surfaces to scrap metal. Material feed hoppers are typically included with various of these grinders and from which the material may be gravitationally fed. Mechanical feed assemblies, such as augers and rams, may also direct the work materials into a grinding head. The grinding head may also be mounted to make direct contact the materials.

Grinders have also been developed to reduce scrap materials and landfill debris into fine particulates for transport or merely to occupy less space at a landfill. U.S. Pat. No. 5,197,682 discloses one such grinder. That grinder provides a trailered operator platform, feed hopper and hydraulic grinding head. Power is supplied from a power take-off at the transport vehicle which drives a pair of hydraulic motors at the grinder, which separately drive opposite sides of the grinding head. Particulate size is controlled at a reduction channel having a hydraulically controlled floor.

Although the foregoing grinder has proven very capable at its task of reducing a wide range of materials, the physical size of the equipment and related economic costs have demonstrated a need for a physically smaller grinder. A modified, sizing chamber at the feed assembly is also desired to provide a longer dwell time for the work material. A mechanism for controlling the size of the ejected particulate is also desired.

The subject invention was developed to meet the foregoing needs and to provide a short bodied, high efficiency grinder with substantially the same material throughput as larger grinders and with greater control over the particulate size.

SUMMARY OF THE INVENTION

It is a primary object of the invention to provide a trailerable, short body reduction grinder having a longitudinally extensible feed ram.

It is a further object of the invention to provide a self-contained power source and hydraulic pump for operating a feed ram, grinding head, shear bar and discharge conveyor.

It is a further object of the invention to provide a longitudinally extensible feed ram having three or more sections which telescope from one another to direct reduction material into a rotary drum grinder head.

It is a further object of the invention to provide a single hydraulic motor and belt drive for rotating the grinding head and advancing and retracting the push ram with an electro-hydraulic controller.

It is a further object of the invention to provide a shear bar at the inlet to facilitate clearing the grinding channel in combination with reversal of the grinding head rotation.

It is a further object of the invention to provide a number of arcuate sizing grates or screens having apertures of differing size and shape and to mount the grates at a fixed distance from the grinding drum to define a grinding channel.

It is a further object of the invention to provide a chair mounted hydraulic controller having a pair of joy sticks to control the feed ram, grinding head, and shear bar.

It is a further object of the invention to provide cross supports at a discharge conveyor which are covered with high density plastic slide bearings to prevent wear to the conveyor belt and efficiently convey the ground material.

Various of the foregoing objects, advantages and distinctions of the invention are obtained in a preferred, trailered construction. The grinder is constructed on a trailer chasis which contains a dedicated power source. A telescoping feed ram is mounted within a feed hopper and cooperates with an arcuate feed channel or sizing chamber to obtain a controlled material reduction. A number of seriatim grates or screens are mounted at a fixed separation to the grinding drum.

An engine, fuel tank, hydraulic pump, and hydraulic fluid reservoir mounts to a fore-end of the trailer chasis, forward of a sound proofed and environmentally controlled operator cab. A pair of seat mounted joy sticks control associated electronically actuated hydraulic controls and, in particular, the extension of a telescoping feed ram at the material feed hopper; the elevation of a shear bar and the exposure of the reduction channel defined intermediate the grinding head and the reduction grates; and the direction and speed of rotation of the grinding head in relation to the load.

Arcuate sections of the sizing grates mount about the drum and progressively provide pluralities of holes of increasing size. The height of the reduction channel or distance of the grates from the grinding head increases from the inlet to the outlet end. The geometric shape of the holes at each grate section are progressively varied to collectively size the discharged particulate as the reduction material traverses the feed channel. The size reduced particulates are ejected onto an outfeed or discharge conveyor.

The discharge conveyor is hinged to the trailer chassis beneath the grinding head. Hydraulic couplers couple drive fluid to a single, end mounted drive motor. A plurality of high density plastic slide bearings mount to cross support braces beneath the conveyor belt to facilitate belt rotation and sustain belt life.

Still other objects, advantages, and distinctions are obtained with the improved grinding equipment of the invention and which are more fully described below with respect to the appended drawings. Various considered modifications and improvements are described as appropriate with respect to the description. The description should not be literally construed in limitation of the scope of the invention, which rather should be interpreted within the spirit and scope of the further appended claims.

DESCRIPTION OF THE PREFERRED EMBODIMENT

Figure 1:
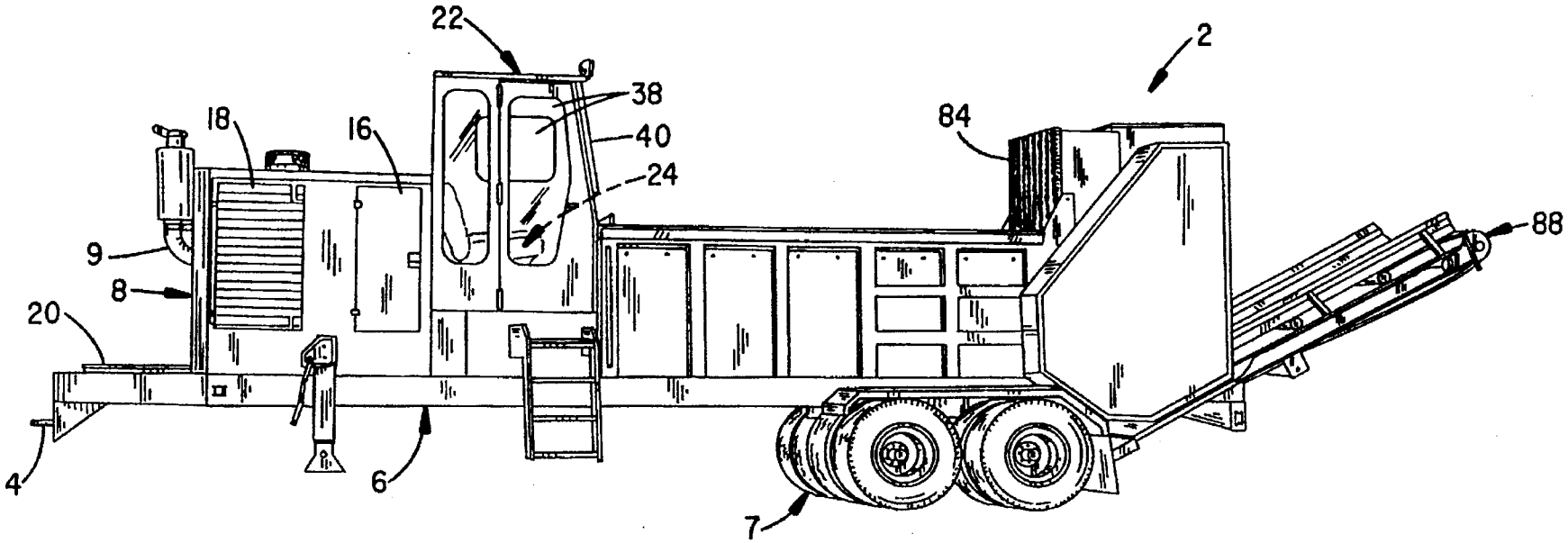
FIG. 1 is a perspective drawing to the reduction grinder of the invention.

With attention to FIG. 1, the improved, short bodied reduction grinder 2 of the invention is shown as it typically appears when disconnected from a towing vehicle. The grinder 2 can be towed by a variety of vehicles but most typically is transported with a dump truck having a pintle coupler 4. Depending on the vehicle, any other appropriate coupler, such as a fifth wheel coupler, can be fitted to the support frame or trailer chasis 6 upon which the grinder 2 is constructed to mate with the towing vehicle. A multi-wheel axle assembly 7 supports the chasis 6.

Figure 8:
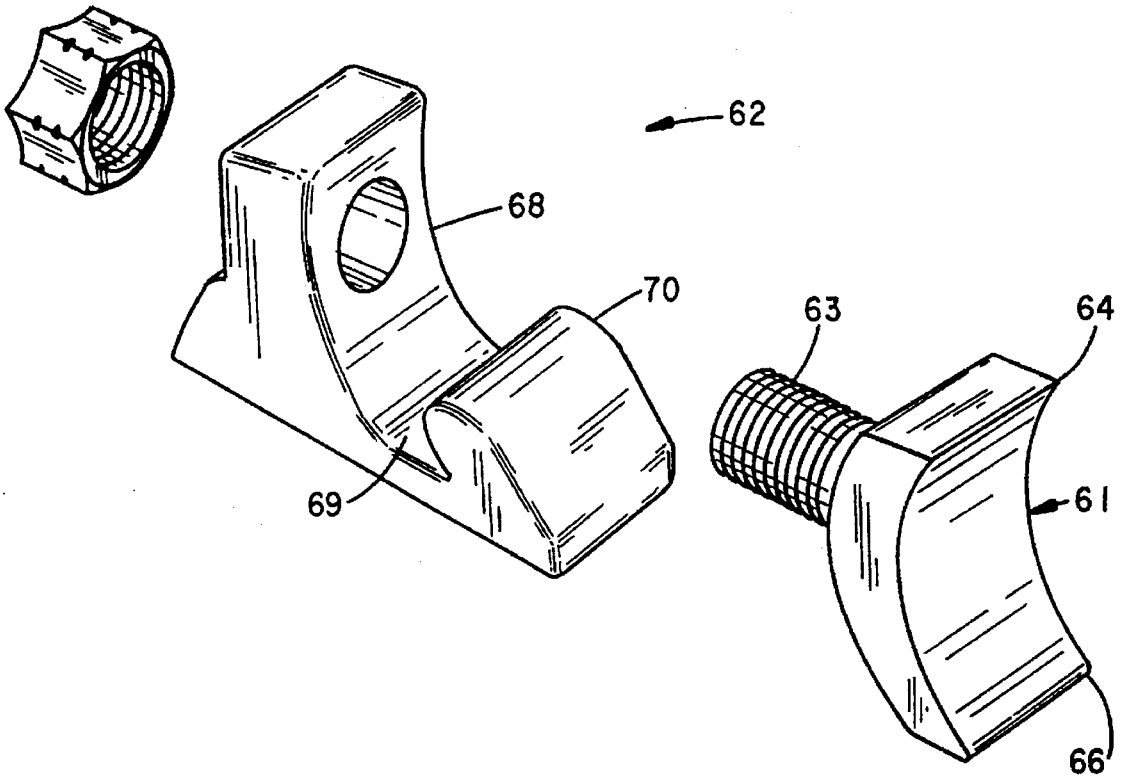
FIG. 8 is an perspective drawing shown in exploded assembly to a reversible grinding tooth which may be used with the grinding head.

With additional attention to FIG. 8 and mounted to the fore-end of the chasis 6 beneath a covered cabinet 8 are a power source or engine 9, closed loop hydraulic pump 10, tandem gear pump 11, drive coupler 12, hydraulic fluid reservoir 13 and fuel tank 14. Various other supply and control equipments such as filters 15, strainers 17, heat exchanger 19, fluid manifolds, and joy stick controlled solenoid valves, also shown at FIG. 8, are contained within the cabinet 8. A variety of access doors 16 and vents 18 are formed into the cabinet 8. A tool storage compartment 20 is also provided at the fore-end of the chasis 6. The grinder 2 is powered with a 260 hp engine 9 versus a 425 hp engine at the grinder of U.S. Pat. No. 5,197,682.

Figure 7:
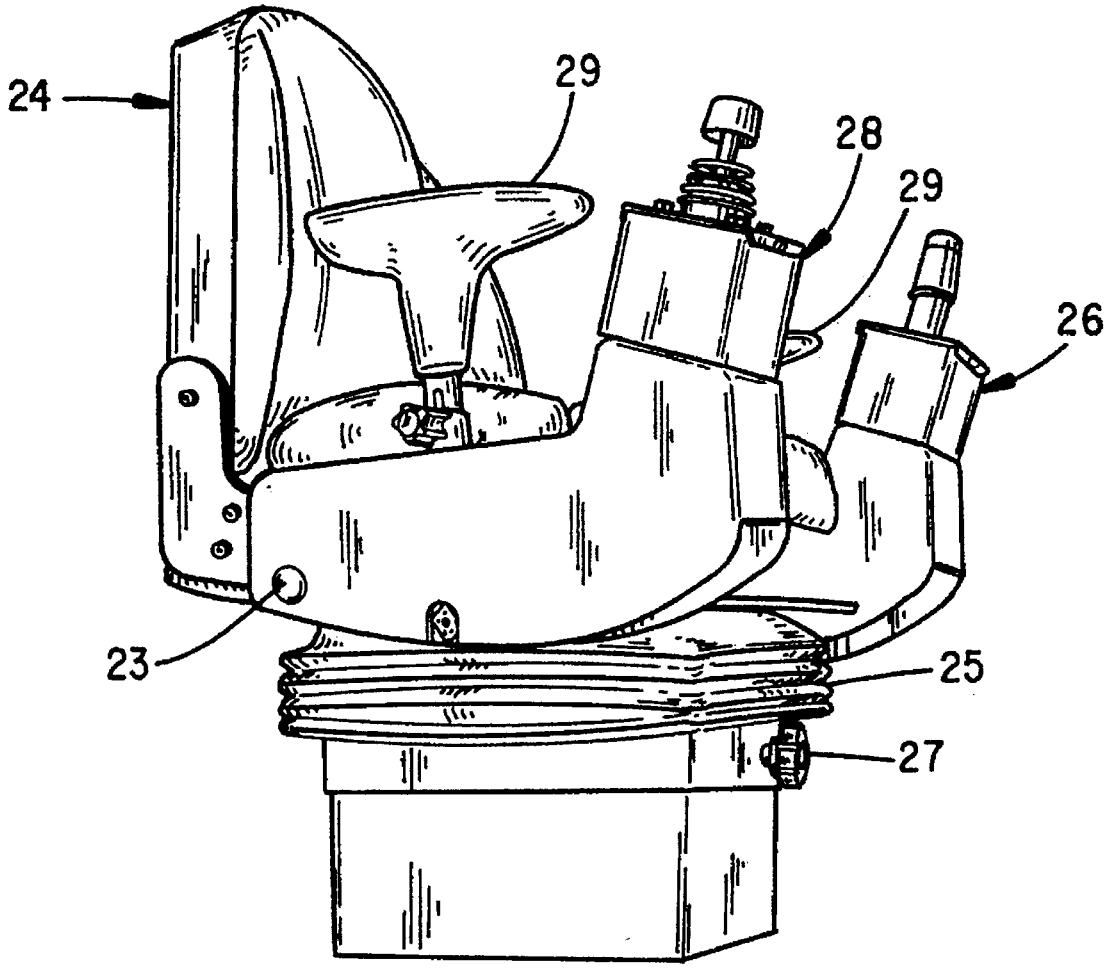
FIG. 7 is a perspective drawing to the operator chair.

Mounted forward of the cabinet 8 is an enclosed operator cab 22. The cab 22 includes a cushioned, control chair 24 which has a pair of joy sticks 26 and 28 supported at the arms of the chair 24, reference FIG. 7. The joysticks 26 and 28 control the principal functions of the grinder 2. That is, the operation of a telescoping feed ram 30, which is partially mounted beneath the cab 22, reference FIG. 2; the movement of a shear bar cylinder 32; the direction and speed of a grinder motor 34; and a conveyor motor 36, reference FIG. 9.

The chair 24 provides an air cushioned base 25 and height adjuster 27. The arm containing the joy stick 28 is also mounted to pivot rearward at a joint 23 to facilitate entry by an equipment operator. Height and tilt adjustable forearm rests 29 are also fitted to each arm.

Supported about the cab 22 are sundry operating guages, lights 37, and environmental controls such as a heater and air conditioner (not shown). Sound proofing materials are also applied to the walls and floor of the cab 22 to allow the operator to concentrate on the operation of the grinder. Side and front safety windows 38 and 40 permit the operator to view the work area and movements of an attending front end loader or other support equipment which collects and deposits the reduction materials into the grinder 2. Two way radio communications with any attending personnel may also be incorporated into the cab 22. The front window 40 is covered with a protective grate 42 to guard against materials which might be accidently discharged from the feed hopper 44.

With attention to FIGS. 2 through 5, mounted beneath the cab 22 and secured to the chasis 6 at an anchor bracket 45 is the telescoping feed cylinder 30 which forces reduction materials into the grinding head. The cylinder 30 compresses to a length of 52 inches, which has particularly enabled the shortened structure of the grinder 2. A pair of extensions 46 nest within the primary cylinder 48 and when the cylinder 30 is fully extended provide an extension length of 148 inches.

A ram head 50 is mounted to slide within the material feed hopper 44. Studs 52 project from the face of the ram head 50 and grip the reduction materials to assist in preventing possible discharge of materials from the hopper 44.

Mounted at the forward end of the hopper 44 is a shear bar 58 and a grinding head 60. The head 60 is constructed in the form of a cylindrical drum. Supported about the circumference of the head 60 are a number of teeth 61 which appropriately act on the reduction material to abrade, shred, or grind the material as desired. The teeth 61 may be selected from a variety of conventional constructions.

Figure 9:
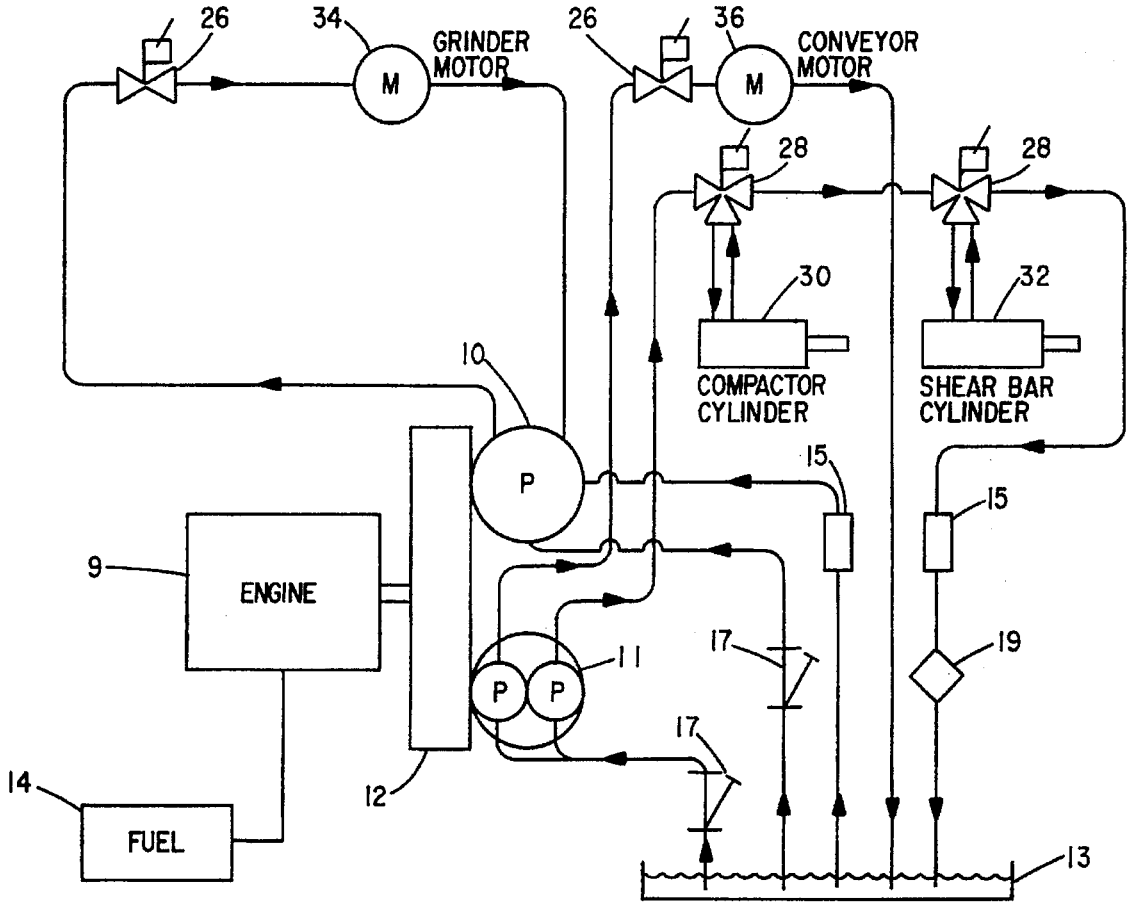
FIG. 9 is a schematic diagram to the electrohydraulic controller.

A reversible tooth 62, reference FIG. 9, may also be mounted to the head 60. The tooth 62 provides a head 61 which is secured to a threaded shank 63 and from which two cutting edges 64 and 66 project. The edges 64 and 66 can be constructed to most advantageously interact with differing materials. The edges 64 and 66 can be cut to provide different shapes most compatible with any desired material. One of the edges 64 and 66 nests within a holder 68 and is protected in a recess 69 behind a blunt leading edge 70.

The tooth 62 allows the grinder operator, as necessary, to either reverse the edges 64 and 66 to accommodate differing materials or present a fresh, sharp edge without having to change the grinding head 60. The tooth 62 presents particular advantages for operators who engage in subcontract work and who may be called on to make frequent changes of the head 60 or individual teeth 61 to accomodate different reduction materials.

Surrounding the grinding head 60 is a shrouded enclosure 82 which is constructed to contain the reduction materials to a reduction channel adjacent the grinding head 60. A number of chains depend from a forward surface of the enclosure 82 to form a curtain 84. The curtain extends to a point slightly above the head 60 and serves to deflect any materials into the head 60 which may follow the head 60 through the reduction channel, instead of being discharged, or which may buck upward as the ram head 50 pushes the materials into the grinding head 60.

A heavy rubber shroud 86 is hinged to the back of the enclosure 82 to overly a discharge conveyor 88. The conveyor 88 projects from the rear of the grinder 2 and collects the ground material and conveys the material to an adjacent pile or waiting truck. The rubber shroud 86 is mounted to a horizontal support bar 87 which is hinged at one end to the enclosure 82 and latched at the other end to a latch 89. Although the ground materials normally fall onto the conveyor 88, like the curtain 84, the shroud 86 deflects any errant materials onto the conveyor 88.

The hinge mounting of the shroud 86 also permits access to the shear bar 58, grinding head 60, and the sizing assembly 90 and a number of arcuate screens or grates 92 and 94 and 95 which comprise the assembly 90. The grates 92 and 94 substantially surround the grinding head 60 and define a grinding channel 96. The size of the discharged particulate is principally determined by the size and shape of apertures within the grates 92 and 94.

A leading edge of the grate 92 is secured to the enclosure 82 and extends from a point adjacent the shear bar 58 and follows the bottom contour of the head 60. The grate 94, in turn, mounts to the grate 92 and follows the aft, vertical contour of the head 60 to a cross member 98, where the grate 94 is also secured to the enclosure 82. The bottom wall of the enclosure 82 follows the top contour of the head 60. Any material not ejected at the grate 94 is contained by the enclosure 82 to follow the head 60 back to the hopper 44, where it is readmitted to the grinding channel 96. Ideally only an insignificant amount of material is not ground when first encountering the head 60.

The grates 92 and 94 are secured to the enclosure to define a sizing channel 96 having a leading edge vertical spacing at the grate 92 from the head 60 of ¼ to 1½ inches and a trailing edge spacing at the grate 94 of 1½ to 2½ inches. The larger separation at the trailing edge in combination with the larger apertures discussed below facilitates the substantial grinding of all materials. The separation also reduces the risk of jamming.

Each of the grate sections 92 and 94 includes a number of zones of apertures of differing size and shape. The relative size and shape of each aperture is varied from the lower most, leading grate 92 to the upper most or trailing edge of grate 94. The grate 92 particularly provides a number of circular apertures sized on the order of a 1 to 2 inch diameter at a density of 8 apertures per square foot. The trailing end of grate 92 and leading end of grate 94 provide apertures of 3½ to 5½ inches in the shape of a chevron. The trailing end of the grate 94 provides a number of diamond shaped apertures having 3½ to 4 inch sides. Collectively the shear bar 58 and the screen assembly 90 reduce the reduction material to a particulate size on the order of 1 to 3 inches.

Figure 2:
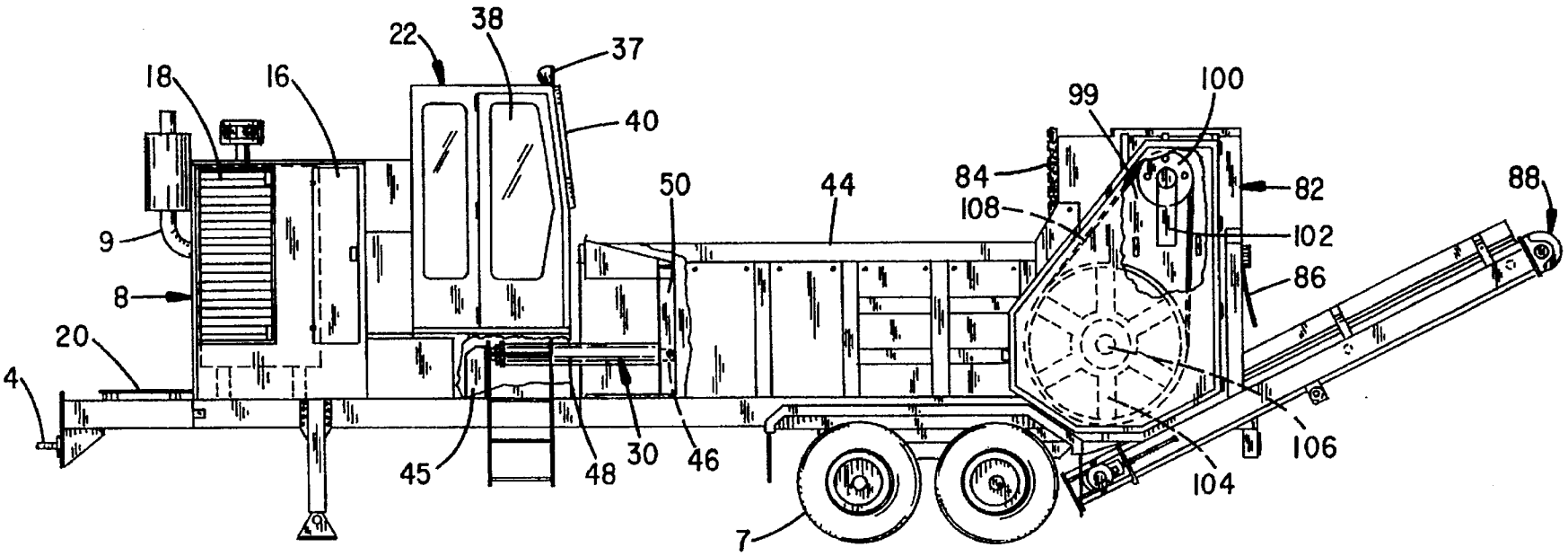
FIG. 2 is a front elevation drawing shown in partial cutaway and depicting the feed ram and grinding head drive belts.
Figure 3:
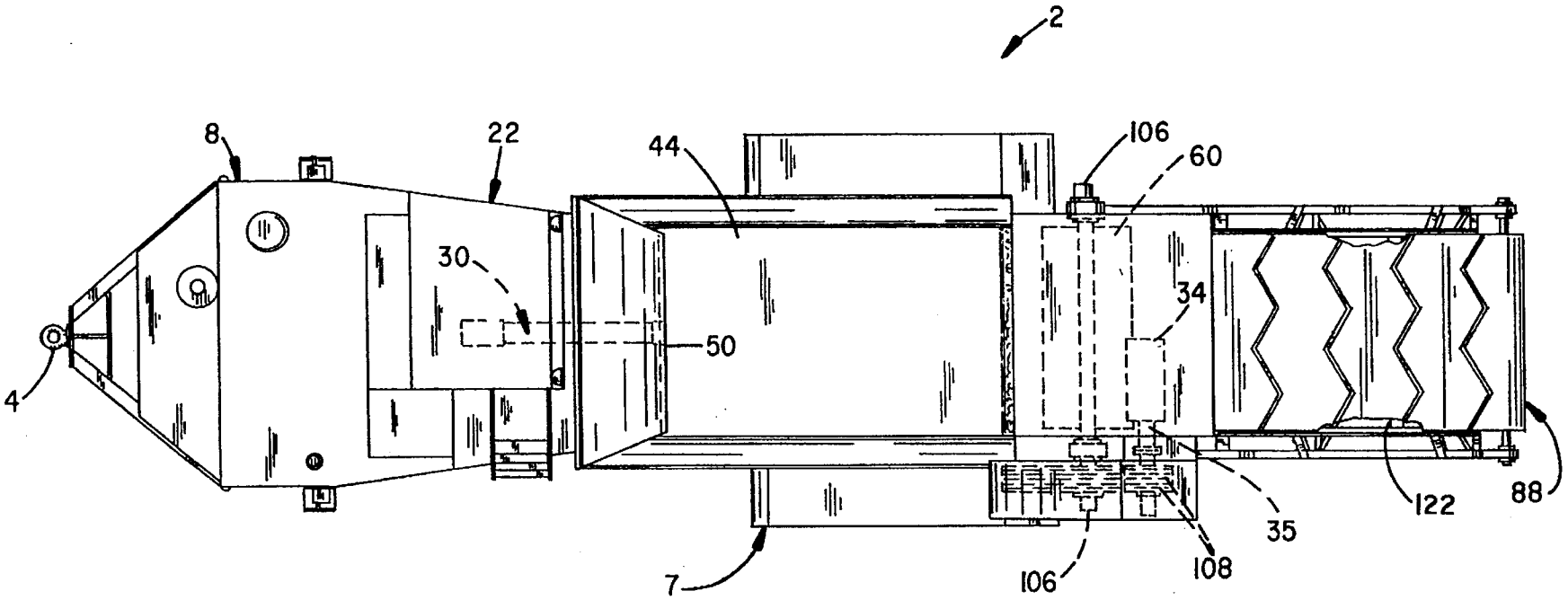
FIG. 3 is a top plan drawing showing the feed ram and grinding drum drive pulleys and belts in dashed line.
Figure 4:
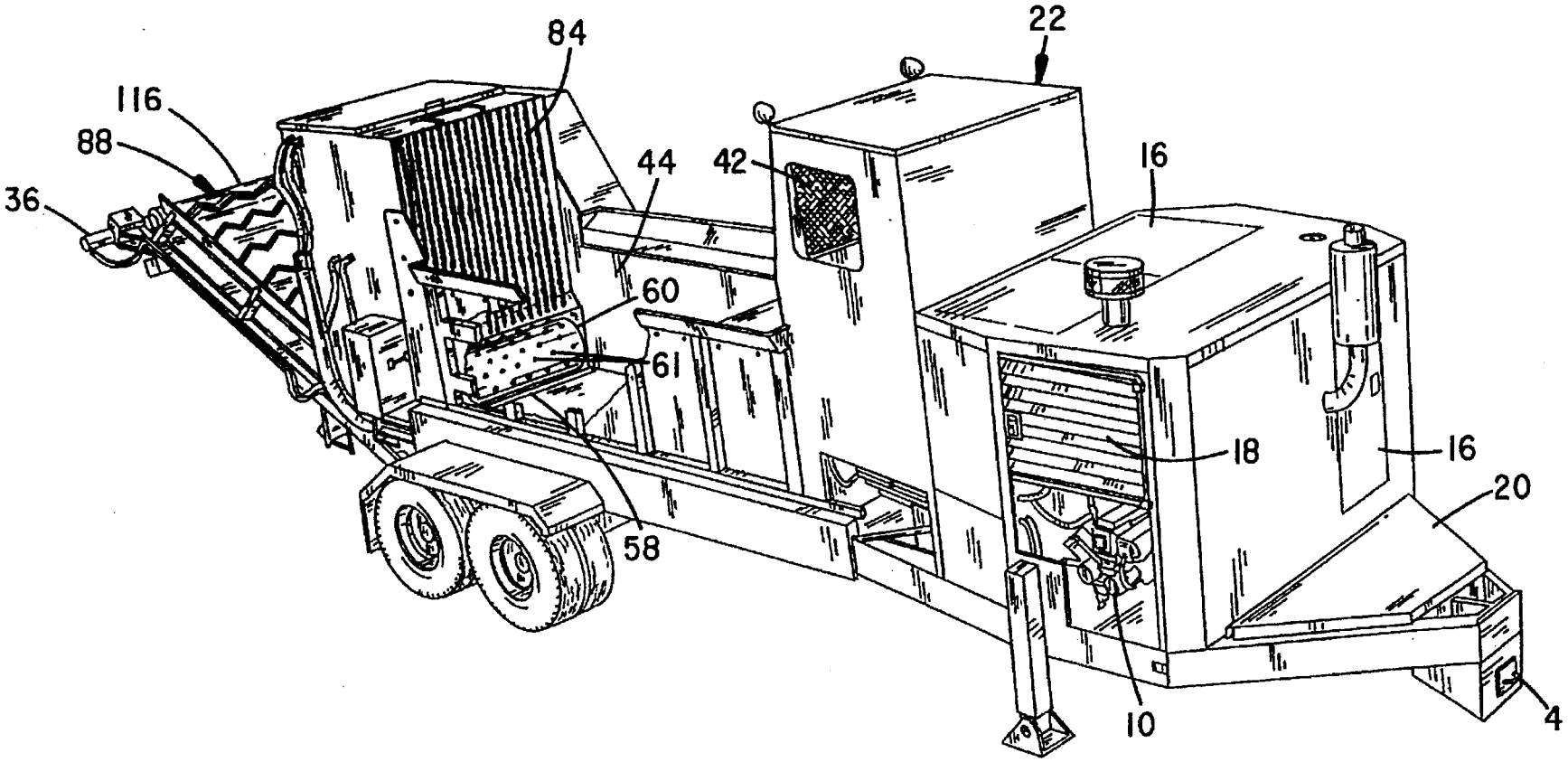
FIG. 4 is a perspective drawing showing the feed hopper, grinding drum and shear bar as seen by an equipment operator.
Figure 5:
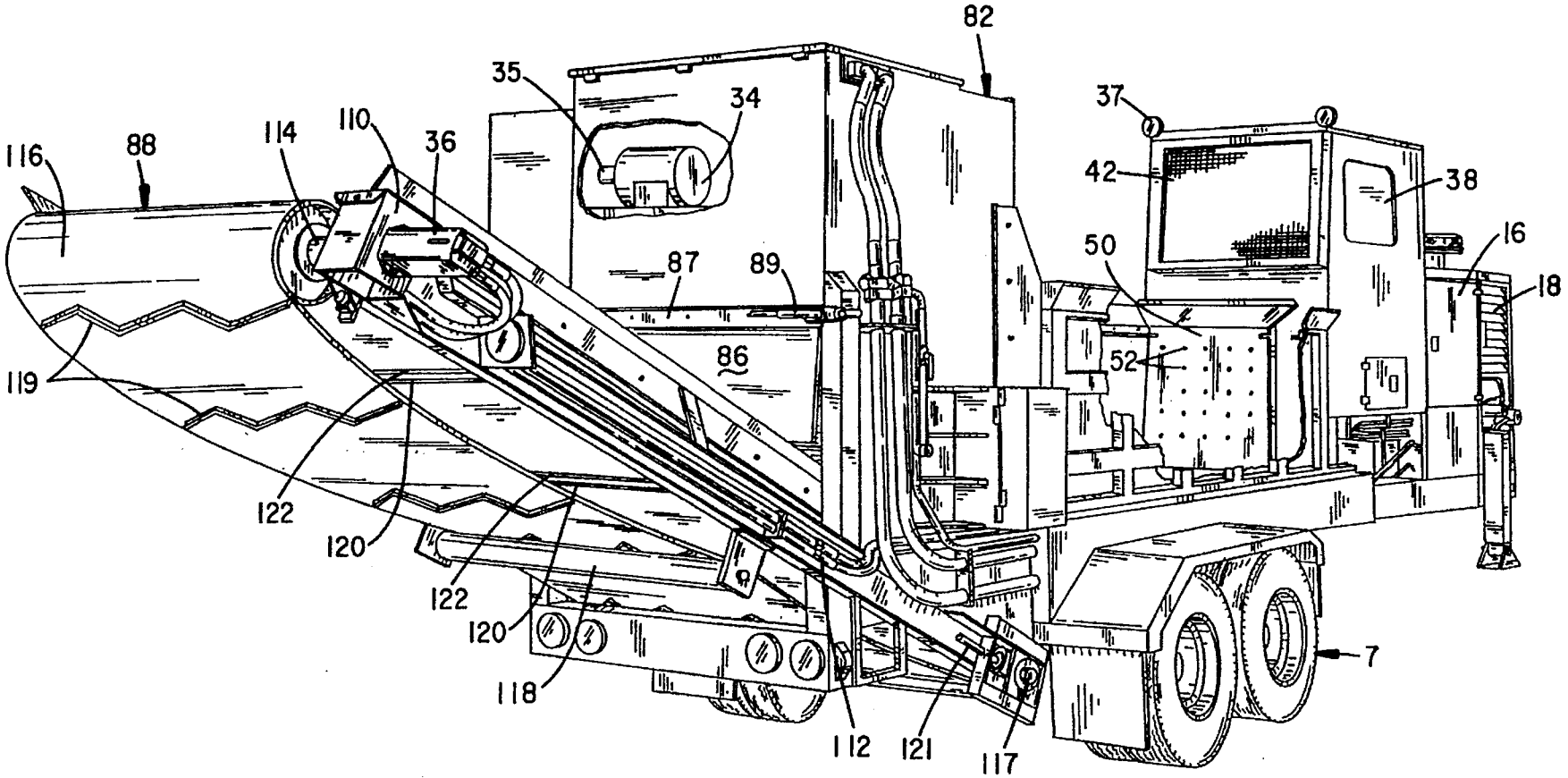
FIG. 5 is a perspective drawing shown in partial cut away, looking from the aft end of the grinder toward the outfeed conveyor belt and push ram.
Figure 6:
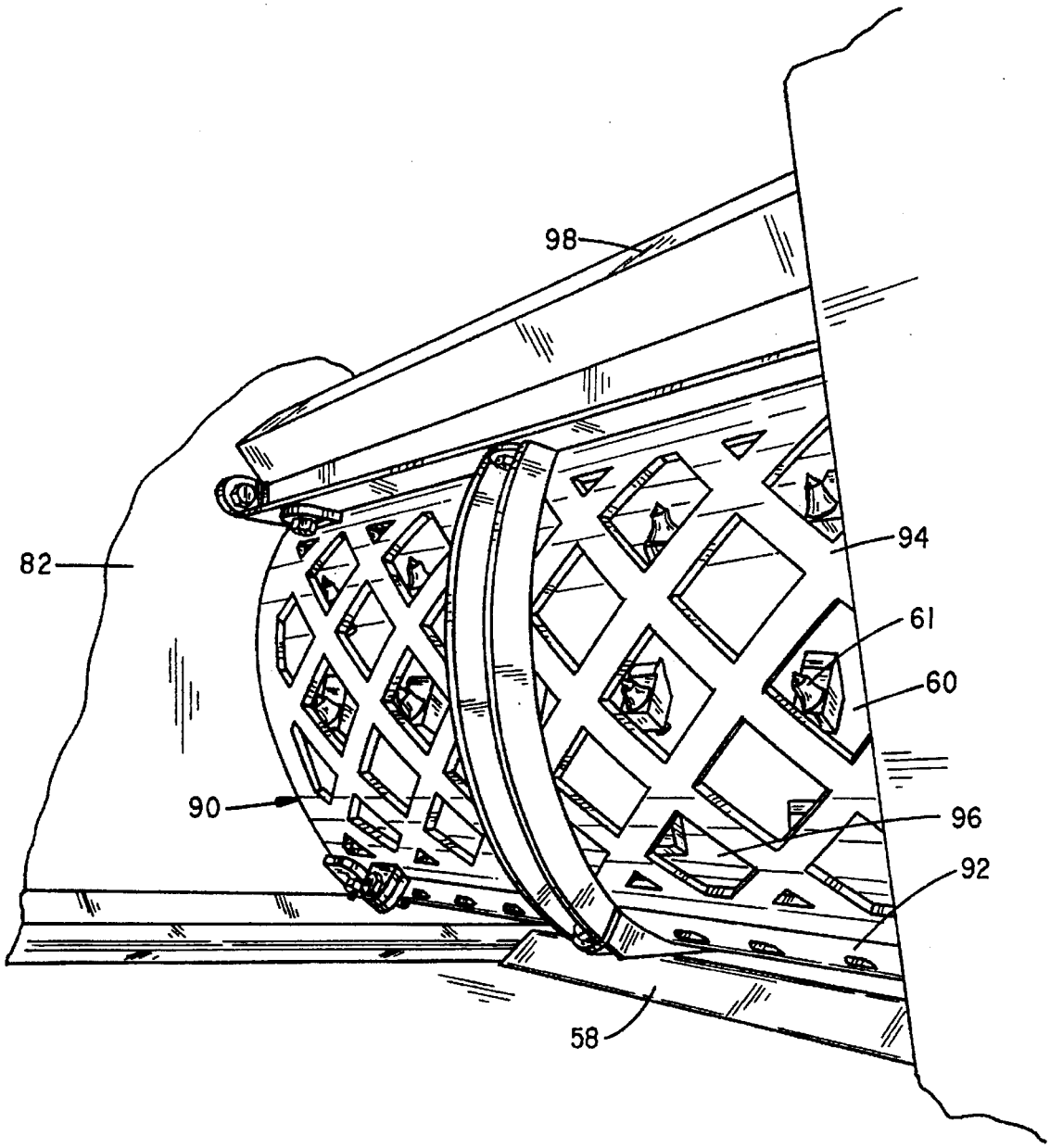
FIG. 6 is a perspective drawing showing the reduction screens or grates and the grinding channel defined between the grates and grinding head.

Mounted to a support plate 99 at the side wall of the enclosure 82 and contained within the enclosure 82 is the single hydraulic motor 34, reference FIGS. 2, 3 and 5. A drive shaft 35 of the motor 34 extends through the plate 99 and is secured to an upper drive belt pulley 100. The pulley 100 is mounted to a support arm 102 that is also secured to the plate 99. A lower, appreciably larger pulley 104 is mounted to an axle 106 that extends through the drive head 60. The plate 99 is mounted such that the plate 99 can be moved and whereby the tension at a number of drive belts 108 can be adjusted at the pulleys 100 and 104. Power is transferred from the upper pulley 100 to the lower pulley 104 and the axle 106 to the head 60. Appropriate bearings are provided at the walls of the enclosure 82 to support the shaft 35 and axle 106.

Mounted beneath the head 60 at the leading edge of the screen assembly 90 and the grinding channel 96 is the shear bar 58. The shear bar 58 forms a portion of the floor of the feed hopper 44. The shear bar 58 is coupled to the shear cylinder 32 and is mounted via available pivot links to permit the bar 58 to be raised and lowered as appropriate to control the exposure to and clear reduction material from the grinding channel 96. That is, the extension and retraction of the cyliner 32 raises and lowers the shear bar 58 to vary the exposure of the grinding channel 96. Upon lowering the bar 58 and reversing the motor 34, jammed materials are readily discharged back into the feed hopper 44 without having to disassemble the screens 90 or remove the head 60.

The shear bar 58 permits operator control to assure the most efficient transfer of power to the work load. The shear bar is controlled with the joy stick 28. The speed and direction of rotation of the grinder head 60 and consequent torque are controlled with the joy stick 26 relative to load demand, although the head speed is normally not varied once established.

Turning attention to the conveyor 88 and to FIG. 5, the support frame 110 of the conveyor 88 is hinged to the grinder chasis 6 at a number of pivot pins (not shown). The elevation of the conveyor frame 110 can thereby be varied as necessary. Hydraulic fluid couplers 112 connect fluid lines which extend through tubular frame members of the chasis 6 and between the chasis 6 and the conveyor frame 110 to the hydraulic conveyor drive motor 36. The joy stick 26 controls the fluid delivered to the drive motor 36 and the speed of rotation of an outboard drive roller 114.

A conveyor belt 116 is trained about the drive roller 114 and an idler roller 117 positioned at the opposite end of the conveyor frame 110 beneath the head 60. A center idler roller 118 also supports the belt 116. The upper surface of the belt 116 includes a number of raised welts 119 which guide the reduction material. A threaded tensioner assembly 121 at the idler roller 117 also permits the adjustment of the tension of the belt 116.

Mounted along the conveyor frame 110 are a number of cross braces 120 which extend between a pair of siderails. Supported to the upper surface of each brace 120 and in contact with the lower surface of the conveyor belt 116 are a number high density plastic slide bearings 122. The slide bearings 122 support the belt 116 and discharged debris while reducing possible abrasion and wear and tear to the belt 116. The bearings 122 have been found to significantly improve the life of the belt 116 and reduce the power requirement to drive the belt 116.

While the invention has been described with respect to a number of presently preferred circuit components and assembly constructions, it is to be appreciated still other constructions may be suggested to those skilled in the art. The scope of the invention should therefore be construed broadly within the spirit and scope of the following claims.

What is claimed is:

1. Grinding apparatus comprising:

a) a multi-wheeled chassis having a frame which supports an operator cab, an engine and hydraulic pump means coupled to said engine for distributing pressurized hydraulic fluids;

b) a feed hopper having a compartment space for collecting reduction materials and mounted to said frame forward of said cab and partially overlying a telescoping hydraulic cylinder, wherein the hydraulic cylinder comprises a body having a plurality of piston sections, and wherein the piston sections telescope from one another and said body;

c) shear means including a bar mounted at the floor of said feed hopper and means for raising and lowering said bar;

d) grinding means including a grinding head exposed at a wall of said feed hopper and coupled to a grinding motor and a belt drive linkage and having a plurality of teeth secured to a surface exposed to contact the reduction materials;

e) a plurality of grates mounted to define an arcuate reduction channel about said grinding head, wherein said grates include a plurality of apertures of progressively increasing size from a leading edge to a trailing edge of said reduction channel, and wherein the bar of said shear means controls the exposure to said reduction channel;

f) feed means having a ram head mounted to said telescoping cylinder for directing reduction materials into said grinding head; and g) control means for distributing said hydraulic fluid to said telescoping cylinder, said shear means and said grinding motor.

2. Apparatus as set forth in claim 1 wherein said grates are mounted closer to said grinding head at a leading edge and further away at a trailing edge of said reduction channel.

3. Apparatus as set forth in claim 1 including a discharge conveyor mounted to said frame and having a conveyor motor coupled to said control means, wherein said conveyor includes a plurality of cross supports each having a slide bearing mounted to a surface contacting a conveyor belt.

4. Apparatus as set forth in claim 3 wherein said slide bearing comprises a strip of high density plastic.

5. Apparatus as set forth in claim 3 wherein said conveyor belt includes a plurality of raised welts which project form said belt.

6. Apparatus as set forth in claim 1 wherein said control means includes first and second joy sticks coupled to solenoid valves and mounted to the arms of an air cushioned chair supported in said cab.

7. Apparatus as set forth in claim 1 wherein said grinding head includes a plurality of teeth having first and second cutting edges and including a holder for sheltering one of said first and second edges, whereby the protected one of said cutting edges can be selectively exposed when needed.

8. Apparatus as set forth in claim 7 wherein said first and second cutting edges are constructed to complement different reduction materials.

9. Apparatus as set forth in claim 1 wherein the apertures of each of said plurality of grates exhibit differing shapes.

10. Grinding apparatus comprising:

a) a multi-wheeled trailer chassis having a frame which supports an operator cab, an engine and hydraulic pump means coupled to said engine for distributing pressurized hydraulic fluids;

b) a feed hopper having a compartment space for collecting reduction materials and mounted to said frame forward of said cab and partially overlying a telescoping hydraulic cylinder, wherein the hydraulic cylinder comprises a body having a plurality of piston sections, and wherein the piston sections telescope from one another and said body;

c) shear means including a bar mounted at the floor of said feed hopper and means for raising and lowering said bar;

d) grinding means including a grinding head exposed at a wall of said feed hopper and coupled to a grinding motor and a belt drive linkage coupled to one end of said grinding head and having a plurality of teeth secured to a surface exposed to contact the reduction materials;

e) a plurality of grates mounted to define an arcuate reduction channel about said grinding head, wherein each of said grates includes a plurality of apertures, wherein the size aperture of each grate is different from the other grates and the grates are mounted to present apertures of progressively increasing size from a leading edge to a trailing edge of the reduction channel, wherein said grates are mounted closer to said grinding head at a leading edge and further away at a trailing edge of said reduction channel, and wherein the bar of said shear means controls the exposure to said reduction channel;

f) feed means having a ram head mounted to said telescoping cylinder for directing reduction materials into said grinding head;

g) control means including first and second joy sticks coupled to solenoid valves for distributing said hydraulic fluid to said telescoping cylinder, said shear means and said grinding motor; and h) a discharge conveyor mounted to said frame and having a conveyor motor coupled to said control means, wherein said conveyor includes a plurality of cross supports a high density plastic bearing at a surface contacting a conveyor belt.

11. Apparatus as set forth in claim 10 wherein the apertures of each of said plurality of grates exhibit differing shapes.

12. Grinding apparatus comprising:

a) a multi-wheeled trailer chassis having a frame which supports an operator cab, an engine and hydraulic pump means coupled to said engine for distributing pressurized hydraulic fluids;

b) a feed hopper having a compartment space for collecting reduction materials;

c) shear means including a bar mounted at the floor of said feed hopper and means for raising and lowering said bar;

d) grinding means including a grinding head exposed at a wall of said feed hopper and coupled to a grinding motor and a belt drive linkage coupled to one end of said grinding head and having a plurality of teeth secured to a surface exposed to contact the reduction materials;

e) a plurality of grates mounted to define an arcuate reduction channel about said grinding head, wherein each of said grates includes a plurality of apertures, wherein the size and shape aperture of each grate is different from the other grates and the grates are mounted to present apertures of progressively increasing size from a leading edge to a trailing edge of the reduction channel, wherein said grates are mounted closer to said grinding head at a leading edge and further away at a trailing edge of said reduction channel, and wherein the bar of said shear means controls the exposure to said reduction channel;

f) a telescoping hydraulic cylinder coupled to a ram head containing a plurality of teeth, wherein the hydraulic cylinder comprises a body having a plurality of piston sections, wherein the piston sections telescope from one another and said body, and wherein said ram head is mounted within said feed hopper to direct reduction materials into said grinding head; and g) control means for distributing said hydraulic fluid to said telescoping cylinder, said shear means and said grinding motor.

13. Apparatus as set forth in claim 12 including a discharge conveyor mounted to said frame and having a conveyor motor coupled to said control means, wherein said conveyor includes a plurality of cross supports each having a slide bearing mounted to a surface contacting a conveyor belt.

* * * * *